US005510085A

United States Patent [19]

Abdulally

[11] Patent Number: 5,510,085

[45] Date of Patent: Apr. 23, 1996

[54] FLUIDIZED BED REACTOR INCLUDING A STRIPPER-COOLER AND METHOD OF OPERATING SAME

[75] Inventor: Iqbal F. Abdulally, Randolph, N.J.

[73] Assignee: Foster Wheeler Energy Corporation, Clinton, N.J.

[21] Appl. No.: 422,663

[22] Filed: Apr. 10, 1995

Related U.S. Application Data

[63] Continuation of Ser. No. 152,948, Nov. 15, 1993, abandoned, which is a continuation of 966,966, Oct. 26, 1992, abandoned.

[51] Int. Cl.[6] ..... F27B 15/00

[52] U.S. Cl. ..... 422/142; 422/143; 422/145

[58] Field of Search ..... 422/139, 141, 422/142, 143, 145–147; 122/4 D; 34/57 A, 57 B, 57 R, 579, 583, 585, 589, 591; 110/245; 165/104.16; 431/7, 170; 432/58

[56] References Cited

U.S. PATENT DOCUMENTS

| | | | |
|---|---|---|---|
| 3,401,465 | 9/1968 | Larwill | 34/57 A |
| 3,589,027 | 6/1971 | Duzan | 34/57 R |
| 4,688,521 | 8/1987 | Korenberg | 122/4 D |
| 4,709,662 | 1/1987 | Rawdon | 122/4 D |
| 4,809,623 | 3/1989 | Garcia-Mallol | 122/4 D X |
| 4,809,625 | 3/1989 | Garcia-Mallol et al. | 122/4 D X |
| 4,828,486 | 5/1989 | Sakamoto et al. | 122/4 D X |
| 4,829,912 | 5/1989 | Alliston et al. | 122/4 D X |
| 4,947,804 | 8/1990 | Abdulally | 122/4 D |
| 4,955,295 | 9/1990 | Abdulally | 122/4 D X |
| 5,069,170 | 12/1991 | Gorzegno et al. | 422/146 X |
| 5,095,854 | 3/1992 | Dietz | 122/4 D |
| 5,140,950 | 8/1992 | Abdulally | 422/145 X |

FOREIGN PATENT DOCUMENTS

| | | |
|---|---|---|
| 0393931 | 10/1990 | European Pat. Off. . |
| 56-66643 | 10/1979 | Japan . |
| 2032598 | 5/1980 | United Kingdom . |

OTHER PUBLICATIONS

W. Howe, C. McGowin "Fluidized Bed Combustion of Alternative Fuels: Pilot and commercial Plant Experience", 1991, Int'l Conf. on Fluidized bed Combustion, pp. 935–946.

I. Abdulally, R. Voyles, A. Libal, "Multiple Fuel Firing Experience in a Circulating Fluidized Bed Boiler," Annual Meeting of the American Power Conference, Apr. 13–15, 1992.

*Primary Examiner*—Timothy M. McMahon
*Attorney, Agent, or Firm*—Marvin A. Naigur

[57] ABSTRACT

A fluidized bed reactor and method of operating same in which a bed of particulate material including fuel is formed in a furnace section. A stripper-cooler is located adjacent the furnace section for receiving particulate material from the furnace section. The particulate material is selectively passed to the stripper-cooler and cooled before being discharged from the stripper-cooler.

5 Claims, 2 Drawing Sheets

FLUIDIZED BED REACTOR INCLUDING A STRIPPER-COOLER AND METHOD OF OPERATING SAME

This is a continuation of application Ser. No. 08/152,948, Nov. 15, 1993, abandoned, which is a continuation of Ser. No. 07/966,966 filed on Oct. 26, 1992 now abandoned.

BACKGROUND OF THE INVENTION

This invention relates to a fluidized bed reactor and method for operating same and, more particularly, to a fluidized bed reactor including a stripper-cooler located adjacent the reactor for controlling the circulation and the temperature of the bed material.

Reactors, such as combustors, steam generators and the like, utilizing fluidized beds as the primary source of heat generation, are well known. In these arrangements, air is passed into the furnace section of the reactor and through a bed of particulate material contained therein which includes a mixture of a fossil fuel, such as coal, and an adsorbent, such as limestone, to adsorb the sulfur generated as a result of combustion of the coal. The air fluidizes the bed and promotes the combustion of the fuel. When the reactor is utilized as a steam generator, the heat produced by the combustion of the fuel is utilized to convert water to steam. Fluidized bed reactors provide an attractive combination of high heat release, high sulfur adsorption, low nitrogen oxides emissions and fuel flexibility.

The most typical fluidized bed combustion system is commonly referred to as a "bubbling" fluidized bed in which a dense bed of the particulate material is supported by an air distribution plate, to which the combustion supporting air is introduced through a plurality of perforations in the plate, causing the particulate material to expand and take on a suspended, or fluidized, state. The air velocity is typically two to three times that needed to develop a pressure drop which will support the bed weight (e.g., minimum fluidization velocity), causing the formation of bubbles that rise up through the bed and give the appearance of a boiling liquid.

In an effort to extend the improvements in combustion efficiency, pollutant emissions control, and operation turndown afforded by the bubbling bed, a fluidized bed reactor was developed utilizing an expanded and elutriating fluidized bed commonly referred to as a "circulating" fluidized bed. In these arrangements, the size of the particulate material is decreased and/or the mean air velocity is increased when compared to the bubbling bed, so that the bed surface becomes more diffused and the entrainment of solids from the bed is increased. According to this process, in the lower portion of the furnace section, fluidized bed densities are attained which are well below those typical of bubbling fluidized beds, whereas the upper portion of the furnace section becomes loaded with entrained particulate material, or solids, to a much greater extent than in bubbling fluidized beds. This increased solids entrainment in the upper portion of the furnace section results in a high solids throughput which requires a high solids recycle rate. Reactors having high solids recycle rates require large and expensive separators to separate the entrained solids from the hot combustion gases before the gases pass through a heat recovery area to reduce erosion of the heat recovery surfaces in the heat recovery area. The separated solids are passed back to the fluidized bed.

U.S. Pat. Nos. 4,809,623 and 4,809,625, assigned to the same assignee as the present application, disclose a fluidized bed reactor in which a dense, or bubbling, fluidized bed is maintained in the lower portion of the furnace section, while the bed is otherwise operated as a circulating fluidized bed. The design is such that advantages of both a bubbling bed and a circulating bed are obtained, not the least significant advantage being the ability to utilize particulate fuel material extending over a greater range of particle sizes.

In all of these designs, a homogenous mixture of fuel and adsorbent particulate material is formed with a portion of the fuel particles being unburned, a portion being partially burned, and a portion being completely burned. Similarly a portion of the adsorbent is unreacted, a portion is partially reacted and a portion is completely reacted. The particulate material must be discharged from the system efficiently to accommodate the introduction of fresh fuel and adsorbent. To this end, a portion of the particulate material is usually passed from the lower portion of the bed through a drain pipe to remove that portion from the reactor.

It has been found, however, that the particle size distribution in a fluidized bed, an important operating parameter, can be effectively controlled by recirculating part of this removed particulate material back to the furnace section. This is often accomplished by blowing air through the removed particulate material to strip away and entrain the finer portions of the particulate material and returning them to the furnace section.

For example, in U.S. Pat. No. 4,829,912, assigned to the same assignee as the present application, a method of controlling the particle size distribution in a fluidized bed reactor is disclosed in which air entrains the finer portions of the particulate material removed through the drain pipe by stripping them with a stream of air and recirculating them back to the furnace section. In these types of arrangements, the heat of the nonrecirculated particulate material can be put to productive use, such as to preheat combustion supporting gas or for reheat or superheat duty.

A stripper-cooler located adjacent the furnace section of the reactor can accomplish both the recirculation of the finer portions of the removed particulate material and the removal of heat from the removed but nonrecirculated particulate material. In these types of arrangements, the stripper-cooler receives the particulate material from the furnace section and air is blown through a first section of the stripper-cooler to strip, or entrain, some of the finer portions of the particulate material which are returned to the furnace section. The remaining particulate material in the stripper-cooler is then usually passed to a cooler section where heat is removed from the particulate material by passing water/steam in a heat exchange relation to the particulate material or by blowing air through it before it is discharged from the system. When air is used to remove the heat from the nonrecirculated particulate material, this air is often returned to the furnace section as preheated, combustion-supporting air.

However, in some situations, such as when fuels that generate an excessive amount of relatively fine ash are used, or when a relatively large amount of relatively fine adsorbent has to be used with fuels having a relatively high sulfur content, the relatively fine particle material stripped in the stripper-cooler and returned to the furnace section increases the volume of the fines in the furnace section, or the upper furnace loading, to unacceptably high levels. Excessive upper furnace loading requires larger and more expensive stripper-coolers and separators and/or requires that the furnace be operated at a low stoichiometric condition, which is inefficient.

This upper furnace loading is made worse when the method used to cool the particulate material in the cooler section of the stripper-cooler is by blowing air through it. To achieve a high cooling rate and to prevent agglomeration of the particulate material in the stripper-cooler, the air velocity and flow rate through the cooler section must be relatively high. A high air velocity and flow rate, however, entrains greater amounts of particulate material resulting in an even greater volume of fines returned to the furnace section when this air is used as combustion supporting air, thereby further increasing the upper furnace loading.

Also, these types of stripper-coolers normally operate in a continuous mode, i.e., bed material from the reactor is continuously fed to the stripper-cooler. This results in a relatively short residence time of the material in the stripper-cooler and causes residual combustibles to accumulate in the bed ash which is ultimately drained from the system.

Another problem arises in these type stripper-coolers, especially ones that are partitioned, in connection with the processing of relatively large fuel materials, such as waste materials, tramp materials, etc. More particularly, the large materials tend to accumulate in the lower portion of the fluidized bed in the furnace section and thus, for the most part, are not circulated through the stripper-cooler. Also, those relatively large materials that are passed to the stripper-cooler often become jammed or clogged by the partition walls of the stripper-cooler.

SUMMARY OF THE INVENTION

It is therefore an object of the present invention to provide a fluidized bed reactor and method in which particulate material is removed from the furnace section of the reactor and passed to a stripper-cooler.

It is a further object of the present invention to provide a fluidized bed reactor and method of the above type in which particulate material is selectively and periodically removed from the reactor through the stripper-cooler.

It is a further object of the present invention to provide a fluidized bed reactor and method of the above type in which the residence time of the particulate material in the stripper-cooler is increased when compared to arrangements in which the particulate material is continuously passed to the stripper-cooler.

It is a further object of the present invention to provide a fluidized bed reactor and method of the above type in which residual combustibles are burned off from the bed ash in the stripper-cooler.

It is a still further object of the present invention to provide a fluidized bed reactor of the above type in which relatively large materials are directed from the furnace section of the reactor to the stripper-cooler for discharge from the stripper-cooler.

It is a still further object of the present invention to provide fluidized bed reactor of the above type having a sloped directional grid extending through the furnace section and the stripper-cooler for supporting the fluidized bed material and directing the material to the stripper-cooler.

BRIEF DESCRIPTION OF THE DRAWINGS

The above brief description as well as further objects, features and advantages of the present invention will be more fully appreciated by reference to the following detailed description of presently preferred but nonetheless illustrative embodiments in accordance with the present invention when taken in conjunction with the accompanying drawings in which.

DESCRIPTION OF THE PREFERRED EMBODIMENT

Figure 1:
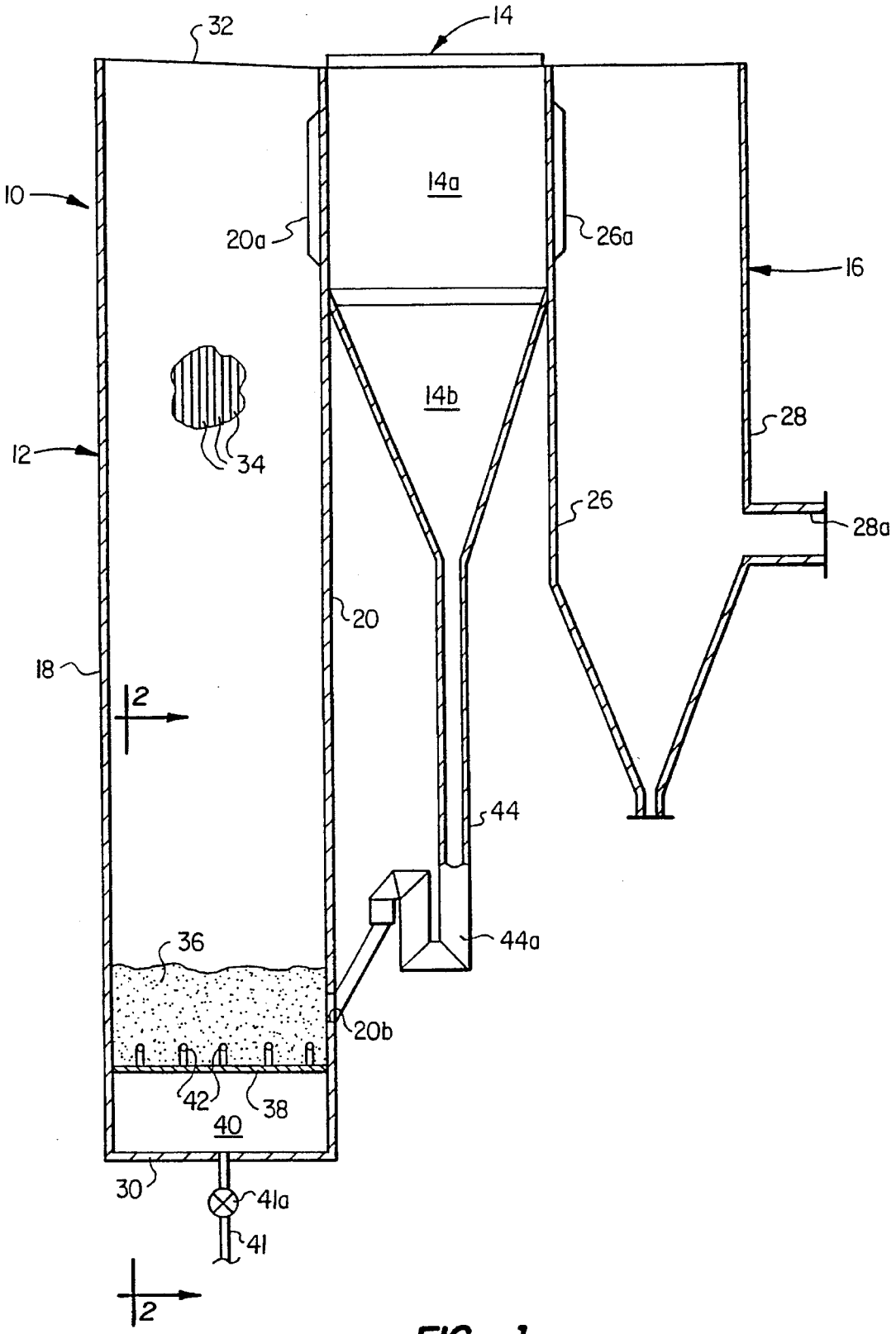
FIG. 1 is a sectional view of the fluidized bed reactor and stripper-cooler of the present invention.

FIG. 1 depicts the fluidized bed reactor of the present invention which is shown in general by the reference numeral 10. The reactor 10 includes a furnace section 12, a separating section 14 and a heat recovery section 16, all shown in cross-section with their internal components removed for the convenience of presentation.

Figure 2:
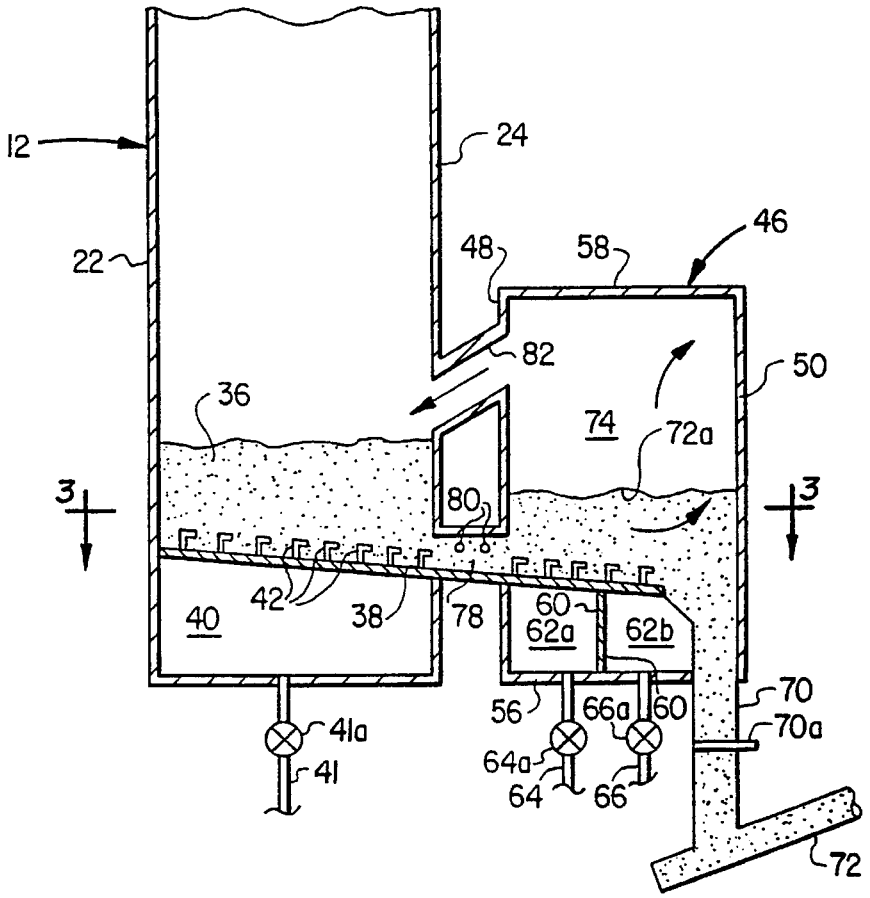
FIG. 2 is a cross-sectional view taken along the line 2—2 of FIG. 1.

Referring to FIGS. 1 and 2, the furnace section 12 is defined by a front wall 18, a rear wall 20 and two sidewalls 22 and 24. Two walls 26 and 28 (FIG. 1) are provided in a spaced parallel relation to the wall 20 with the separating section 14 being defined by the walls 20 and 26, and the heat recovery section 16 being defined by the walls 26 and 28. A floor 30 is provided in the furnace section 12 and a roof 32 extends over the furnace section 12, the separating section 14 and the heat recovery section 16. Although not shown in the drawings, it is understood that the separating section 14 and the heat recovery section 16 are provided with sidewalls, which can be extensions of the sidewalls 22 and 24.

Openings **20*a* and 26*a* are provided in the upper portions of the walls 20 and 26, respectively, for permitting combustion flue gases produced in the furnace section 12 to pass from the furnace section into the separating section 14 and from the separating section to the heat recovery section 16**, as will be explained.

It is understood that if the reactor 10 is used for the purpose of steam generation, the walls 18, 20, 22, 24, 26 and 28 would be formed by a plurality of heat exchange tubes formed in a parallel, gas tight manner to carry the fluid to be heated, such as water, such tubes shown schematically in FIG. 1 and referred to by reference numeral 34. It is also understood that a plurality of headers (not shown) would be disposed at both ends of each of the walls 18, 20, 22, 24, 26 and 28 which, along with additional tubes and associated flow circuitry, would function to route the water through the interior of the reactor and to and from a steam drum (not shown) in a conventional manner. These components are omitted in the drawings for the convenience of presentation.

A bed of particulate material, shown in general by the reference numeral 36, is disposed within the furnace section 12 and rests on a grid, or perforated plate, 38 extending in the lower portion of the furnace section. The plate 38 is sloped downwardly from the from wall 22 to the rear wall 24 and extends through an opening formed in the latter wall as will be described in detail later.

The bed 36 consists of discrete particles of fuel material, such as bituminous coal, which are introduced into the furnace section 12 by a feeder or the like in any known manner. It is understood that a sulfur absorbing material, such as limestone, can also be introduced into the furnace section 12 in a similar manner which material absorbs the sulfur generated by the burning coal. It is also understood that a bed light-off burner (not shown) is mounted through the wall 18 immediately above the plate 38 for initially lighting off a portion of the bed 36 during start-up.

A plenum 40 is defined between the plate 38 and the floor 30 and receives pressurized air from an external source via an air conduit 41 under control of a damper 41*a*. A plurality of nozzles 42 extend through perforations provided in the plate 38 and are adapted to discharge air from the plenum 40 into the bed 36. The nozzles 42 are directed to discharge the air in a direction towards the rear wall 24 for reasons to be described.

The air passing through the bed 36 fluidizes the bed to promote combustion of the fuel and combines with the products of combustion to form combustion flue gases which rise by convection in the furnace section 12. The flue gases entrain a portion of the relatively fine particulate material in the furnace section 12 before passing, via the opening 20*a*, into the separating section 14.

The separating section 14 includes a cyclone separator 14*a* which functions in a conventional manner to separate the entrained particulate material from the flue gases. The separated flue gases pass through the opening 26*a* in the wall 26 to the heat recovery section 16 and the separated particulate material, or separated solids, pass into a hopper portion 14*b* of the separating section 14. It is understood that one or more heat exchange units, such as a superheater, reheater or the like can be provided in the heat recovery section 16 for removing the heat from the separated flue gases as they pass downwardly in the section 16 before exiting through an outlet 28*a* extending through the wall 28.

A dipleg 44 extends from the hopper portion 14*b* of the separating section 14 to an opening 20*b* in the wall 20 of the furnace section 12 to pass the separated solids back to the bed 36. The dipleg 44 has a U-shaped portion forming a J-valve 44*a* for preventing the backflow of particulate material and/or gases directly from the furnace section 12 to the separating section 14, it being understood that the J-valve 44*a* could be replaced by an L-valve, seal pot, integral recycle heat exchanger or other device which could prevent the aforementioned backflow.

Figure 3:
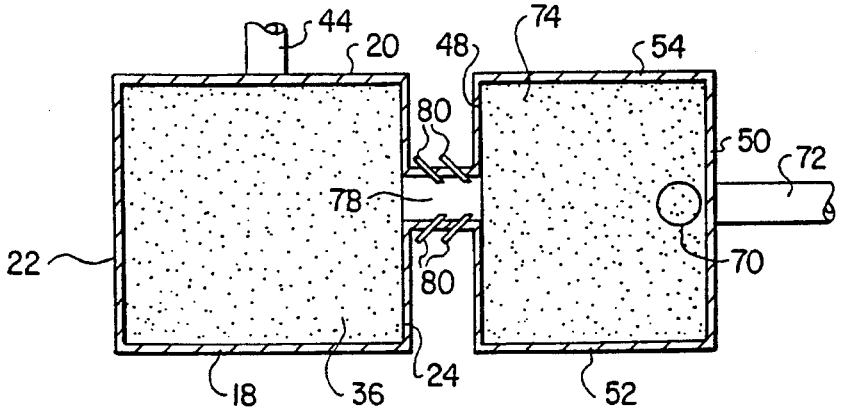
FIG. 3 is a cross-sectional view taken along the line 3—3 of FIG. 2.

Referring to FIGS. 2 and 3, a stripper-cooler 46 is disposed adjacent the sidewall 24 of the furnace section 12. The stripper-cooler 46 is generally rectangular in shape and is defined by a front wall 48, a rear wall 50, two sidewalls 52 and 54 (FIG. 3), a floor 56 and a roof 58. It is understood that if the reactor 10 is used for the purpose of steam generation, the walls 48, 50, 52 and 54 would be formed by a plurality of heat exchange tubes in association with a plurality of headers and flow circuitry as previously described.

As discussed above, the sloped perforated plate 38 extends through the furnace section 12 and through an opening in the wall 24. As shown in FIG. 2, the plate 38 extends further through the wall 48 and into the stripper-cooler 46 in a spaced relationship with the floor 56. Additional nozzles 42 extend through openings in that portion of the plate 38 in the stripper-cooler 46.

A vertical partition 60 extends from the plate 38 to the floor 56 to define two plenums 62*a* and 62*b* there between. Two conduits 64 and 66 respectively communicate with the plenums 62*a* and 62*b* and receive gas, such as air, from an external source to control the air flow to, and the pressure in, the latter plenums. Two control dampers 64*a* and 66*a* are disposed in the conduits 64 and 66, respectively, to provide independent control of the flow to, and pressure in, the plenums 62*a* and 62*b*.

The nozzles 42 supported by the portion of the plate 38 located in the stripper-cooler 46 are directed to discharge air into the fluidized bed above the plate 38 and towards a drain pipe 70 extending through an opening in the floor 56 and located between the end of the plate 38 and the wall 50. A valve 70*a* is provided in the drain pipe 70 to control the flow of ash and particles through the pipe. The drain pipe 70 includes an angularly-extending branch pipe 72 for facilitating removal of bed ash and particles that accumulate in the stripper-cooler 46.

The plate 38 forms the lower boundary, or floor, of a sloping duct 78 connecting the above-mentioned openings formed in the sidewall 24 of the furnace section 12 and the wall 48 of the stripper-cooler 46 to permit the particulate material in the bed 36 of the furnace section 12 to pass into the stripper-cooler 46. To this end, a plurality of air pipes 80 (FIG. 3) extend through the opposite side walls of the duct 78 for discharging air into the duct to promote the flow of the material through the duct and into the stripper-cooler 46. A sloped vent duct 82 connects additional corresponding openings formed in the sidewall 24 of the furnace section 12 and the adjacent wall 48 of the stripper-cooler 46 and is spaced above the duct 78. The vent duct 82 directs air, along with any entrained particles from the stripper-cooler 46 to the furnace section 12 after the air passes through the particulate material in the stripper-cooler 46.

In operation, particulate fuel material and adsorbent are introduced into the furnace section 12 and accumulate on the plate 38 (FIG. 1). Air from an external source passes into the plenum 40 via the air conduit 41, through the plate 38, and the nozzles 42 and into the particulate material on the plate to fluidize the bed 36.

The light-off burner (not shown) or the like is fired to ignite the particulate fuel material in the bed 36. When the temperature of the material in the bed 36 reaches a predetermined level, additional particulate material is continuously discharged onto the upper portion of the bed 36. The air promotes the combustion of the fuel and the velocity of the air is controlled by the damper 41*a* to exceed the minimum fluidizing velocity of the bed 36 to form either a bubbling, circulating or hybrid fluidized bed.

As the fuel burns, and the adsorbent particles are reacted, in the furnace section 12, the continual influx of air through the nozzles 42 creates a homogenous fluidized bed of particulate material including unburned fuel, partially-burned fuel, and completely-burned fuel along with unreacted adsorbent, partially-reacted adsorbent and completely-reacted adsorbent. Due to the sloping of the plate 38 and the action of the directional air nozzles 42 in the furnace section towards the rear wall 24, the particulate material tends to gravitate towards the opening in the latter wall and pass through the opening and the duct 78 and into the stripper-cooler 46.

A mixture of air and the gaseous products of combustion pass upwardly through the bed 36 and entrain, or elutriate, the relatively fine particulate material in the bed. The resulting mixture of flue gases passes upwardly in the furnace section 12 by convection before it exits the furnace section through the opening 20*a* and passes into the separating section 14. The separator 14*a* functions in a conventional manner to separate the entrained particulate material from the flue gases. The separated particulate material, or separated solids, fall by gravity into the hopper 14*b* from which they are injected, via the dipleg 44, back into the bed 36. The relatively clean flue gases pass through the opening 26*a*, into the heat recovery section 16 and through the latter section before exiting the reactor via the outlet 28*a*.

The stripper-cooler 46 is initially void of particulate material and, when it is desired to fill it, the air pipes 80 are activated to discharge air into the duct 78 to promote the flow of particulate material from the bed 36 in the furnace section 12 to the stripper-cooler 46, via the duct 78. This, in combination with the directional discharge of the air from the nozzle 42 towards the stripper-cooler 46, insure that relatively large materials in the furnace section 12 will be transferred to the stripper-cooler. The air to the transfer duct 78, via the air pipes 80, is shut off once the stripper-cooler 46 is filled with material from the furnace 12. Additional air, from the conduit 64, under the control of the damper 64*a*, is introduced into the plenum section 62*a*. The air passes upwardly through the plate 38 and through the nozzles 42 and fluidizes the particulate material flowing into the stripper-cooler 46. The damper 66*a* is controlled as desired to introduce air, via the conduit 66, into the plenum section 62*b*. This air passes upwardly through the plate 38 and the nozzles 42, to further fluidize the particulate material in the stripper-cooler 46. The velocity of the air introduced into the stripper-cooler 46, via the conduits 64 and 66 is carefully controlled by the dampers 64*a* and 66*a* respectively, to control the degree of flow of material into the stripper-cooler 46, the degree of fluidization of the particulate material, the resultant height of the particulate material and the amount of the relatively fine particulate material which is entrained by the air and thus stripped away from the relatively coarse particulate material. The air and entrained fine particulate material pass upwardly through the stripper-cooler 46 and, via the duct 82, back to the furnace section 12.

The air introduced into the stripper-cooler 46 via the ducts 64 and 66 in the foregoing manner removes heat from the particulate material contained therein and promotes the flow of the nonstripped, relatively coarse, particulate material towards the drain pipe 70. The velocity of the air and therefore the degree of flow of the material into the stripper-cooler 46 and the degree of fluidization and the resultant height of the material in the stripper-cooler are respectively controlled as needed by varying the position of the dampers 64*a* and 66*a*.

The particulate material is allowed to reside in the stripper-cooler 46 for a predetermined, relatively long, time before the drain valve 70*a* is opened to drain the material from the stripper-cooler 46.

It is thus seen that the device of the present invention provides several advantages. For example, recirculation of the particulate material in a fluidized bed furnace can be accomplished with a relatively small stripper-cooler since the recirculation rate is decreased by removing some of the particulate material from its furnace section, storing it in the stripper-cooler, and discharging it from the stripper-cooler, thus preventing it from recirculating back into the furnace section. In addition, the amount of particulate material recirculated back into the furnace section from the stripper-cooler can be reduced so that the loading in the upper furnace section of the reactor is not increased, thereby improving the stoichiometric conditions of the reactor as well as reducing the size and expense of the separator section needed to separate the entrained particulate material from the combustion flue gases.

Further, by being able to reduce the amount of entrained particulate material that is recirculated from the stripper-cooler into the furnace section, the air flow and velocity into the stripper-cooler can be increased to prevent agglomeration of the particulate material in the stripper-cooler as well as to increase the cooling efficiency of the stripper-cooler.

Still further, any relatively large material, such as waste material, tramp material, etc. is transferred to the stripper-cooler for ultimate removal from the reactor.

Finally, by operating in a batch cycle mode the solids in the stripper-cooler can be maintained at a higher temperature for a longer time compared to a continuous cycle. This, in turn, results in a longer residence time for burning any residual combustibles in the bed ash and the particulate material in the stripper-cooler.

Changes and substitutions are intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. A fluidized bed reactor comprising:

a furnace containing a bed of particulate material including fuel through which air is passed in a manner to fluidize the particulate material;

a vessel extending to the side of said furnace;

an enclosed duct extending from said furnace to said vessel for connecting said furnace to said vessel;

a plurality of nozzles extending through the side walls of said duct into the interior of said duct and directed in a substantially horizontal direction towards said vessel for introducing air into said duct in a direction towards said vessel to transfer a quantity of said material from said furnace to said vessel;

means for passing air in said vessel to fluidize said material in said vessel and to entrain some of said material in said vessel; and means for connecting said vessel to said furnace for permitting the flow of said entrained material in said vessel back to said furnace.

2. The reactor of claim 1 wherein said duct is inclined downwardly from said furnace to said vessel to promote said transfer of said quantity of material to said vessel.

3. The reactor of claim 1 further comprising means for controlling the velocity of said air in said vessel to control the degree of fluidization of said material in said vessel, the amount of entrained material in said vessel, and the resultant height of the unentrained material in said vessel; and

4. The reactor of claim 1 further comprising means for draining said material from said vessel and means for directing said air in said vessel in a substantially horizontal direction across said material in said vessel and towards said draining means.

5. The reactor of claim 1 wherein said air in said furnace entrains a portion of said material in said furnace, and further comprising means for separating said latter entrained material from said latter air, a heat exchanger, means for passing said separated material from said separating means to said heat exchanger and means for passing said separated material from said heat exchanger back to said furnace.

* * * * *